US005173022A

United States Patent [19]

Sango

[11] Patent Number: 5,173,022

[45] Date of Patent: Dec. 22, 1992

[54] PROCESS FOR PUMPING A GAS/LIQUID MIXTURE IN AN OIL EXTRACTION WELL AND DEVICE FOR IMPLEMENTING THE PROCESS

[75] Inventor: Daniel Sango, Serres Castet, France

[73] Assignee: Societe Nationale Elf Aquitaine (Production), France

[21] Appl. No.: 591,376

[22] Filed: Oct. 1, 1990

[30] Foreign Application Priority Data

Sep. 29, 1989 [FR] France ..... 89 12759

[51] Int. Cl.[5] ..... F01D 11/00

[52] U.S. Cl. ..... 415/169.1; 415/169.2; 415/901; 415/902; 415/903; 417/366; 417/423.8; 417/424.1; 55/406; 166/105.5; 166/265

[58] Field of Search ..... 55/106; 166/105.5, 265; 415/169.1, 169.2, 168.1, 168.4, 213.1, 901, 902, 903; 417/311, 366, 423.3, 423.5, 423.8, 424.1

[56] References Cited

U.S. PATENT DOCUMENTS

| | | | |
|---|---|---|---|
| 1,179,802 | 4/1916 | Chapman | 415/901 X |
| 1,700,928 | 2/1929 | Fawkes | 55/406 X |
| 1,974,183 | 3/1934 | Gunderson | 417/366 |
| 3,398,687 | 8/1968 | Yoshikawa | 417/423.3 X |
| 3,680,976 | 8/1972 | Buse | 415/168.1 |
| 3,887,342 | 6/1975 | Bunnelle | 55/406 X |
| 4,325,678 | 4/1982 | Kanamarn et al. | 415/122.1 X |
| 4,481,020 | 11/1984 | Lee et al. | 55/406 X |
| 4,632,184 | 12/1986 | Renfroe, Jr. et al. | 166/105.5 |
| 4,981,175 | 1/1991 | Powers | 55/406 X |

*Primary Examiner*—Edward K. Look
*Assistant Examiner*—Todd Mattingly
*Attorney, Agent, or Firm*—Bacon & Thomas

[57] ABSTRACT

The present invention relates to a process for pumping a two-phase gas/liquid mixture in an extraction well (11) whose initial gas percentage is greater than approximately 40% by volume, characterized in that it consists:

in reducing the percentage of free gas to below 40% by the use of at least a first centrifugal separating module (3, 4);

in cooling the drive motor by means of an annular flow of the mixture emerging from the first separating module (3, 4) around the motor (9), the proportion of gas in the said mixture having been brought down to below 40% in order to increase its heat capacity and its speed of passage around the motor;

in reducing to below approximately 10% the percentage of gas by volume by the use of at least a second centrifugal separating module (14);

in pumping the fluid thus obtained by means of a centrifugal pump (16) driven by the motor (9).

8 Claims, 3 Drawing Sheets

PROCESS FOR PUMPING A GAS/LIQUID MIXTURE IN AN OIL EXTRACTION WELL AND DEVICE FOR IMPLEMENTING THE PROCESS

The present invention relates to a process for pumping a gas/liquid mixture in an oil extraction well and to the device for implementing the process.

The production of hydrocarbons in an oil well is carried out, either within the framework of a naturally eruptive well, in a natural manner, or in an artificial manner, and in this case the well must be activated. In the first case, the base pressure is sufficient to enable the fluid to rise to the surface. In the second case, the pressure is insufficient to permit extraction, which requires a means of assistance to ensure that the fluid rises to the surface. The well is then activated.

Moreover, after a certain exploitation time, eruptive wells are no longer eruptive and they must also be activated.

Consequently, in order to effect the exploitation of the fluids formed by the hydrocarbons, various activation techniques are used, such as:

gas lift (injection of gas at the bottom);

alternate pumping;

centrifugal pumping;

jet-effect pumping, etc.

Each of these various activation means will be used as a function of the characteristics of the well and of the range of application of the means. Thus, gas lift will be used when the fluid is already gassed, or, conversely, pumping will not be used if the gas quantities are large.

Immersed electrical centrifugal pumping is one of the conventional means and is widespread. The conventional assembly is composed of a multicellular centrifugal pump, an electric motor and a protector located between the motor and the pump and whose role is to ensure a seal around the drive shaft in such a manner that the external fluids do not penetrate into the motor.

However, this type of material has limitations due in particular to the proportion of gas contained in the mixture to be extracted from the well. Thus, when the proportion in the mixture produced reaches values of 10% by volume relative to the total effluent, the centrifugal pump is no longer able to function. The percentages mentioned in the text are the percentages by volume at the pressure and temperature base conditions. This disadvantage considerably limits the uses of centrifugal pumping according to the characteristics of the well, and, in order to tackle this problem, a centrifugal separator has been designed and used which, placed upstream of the pump between the latter and the motor, makes it possible for a partial separation of the gas to be achieved.

When the flow rates are relatively low, less than 300 to 400 $m^3$ per day, such a system makes it possible to obtain a partial elimination of the gas, which will permit normal operation of the pump. This is possible provided that the percentage of free gas in the initial mixture is less than approximately 40% by volume. In this case, the separator brings the percentage of free gas down to approximately 10%.

In the case of mixtures which are greater than approximately 40%, besides the fact that the above device is no longer operating, the heat capacity of the mixtures is insufficient, and the cooling of the electric motor can no longer be ensured satisfactorily.

A first object of the invention is therefore to propose a process for pumping a two-phase gas/liquid mixture which makes it possible to effect the exploitation of the well whose percentage of free gas in the initial mixture is greater than approximately 40% by volume.

This object is achieved by the fact that the process for pumping a two-phase gas/liquid mixture in an extraction well whose initial gas percentage is greater than approximately 40% by volume, is characterized in that it consists:

in reducing the percentage of free gas to below 40% by the use of at least a first centrifugal separating module;

in cooling the drive motor by means of an annular flow of the mixture emerging from the first separating module around the motor, the proportion of gas in the said mixture having been decreased in order to increase its heat capacity and its speed of passage around the motor;

in reducing to below approximately 10% the percentage of gas by volume by the use of at least a second centrifugal separating module;

in pumping the fluid thus obtained by means of a centrifugal pump driven by the motor.

A second object of the invention is to propose a device enabling the process to be implemented and which is capable of solving both the problem of pumping mixtures whose quantities of gas may be as much as 99% by volume and the problem of cooling the drive motor of the device.

This object is achieved by the fact that the device comprises:

a first module, which is a separator of gases in a mixture, is centrifugal, has an axial flow, is arranged in a cylindrical casing, and whose separated gases are discharged outside the casing;

a cooling module comprising an outer casing connected in a sealing manner to the casing of the first separating module and comprising on the inside a second coaxial cylindrical casing containing an electric motor which is surrounded on either side, in the longitudinal direction, by protectors ensuring a seal towards the upstream and downstream sides at the level of the drive spindles of the motor;

means at the entry of the cooling module, for diverting the axial flow of the first separating module outside the second casing, and means at the exit of the cooling module for bringing the flow along the axis of a centrifugal pump module connected to a pipe string for discharging the fluid leaving the cooling module, the said centrifugal pump module and the separating module being driven by the spindle of the motor.

Another object is to adapt the system as a function of the characteristics of the well by the use of either a modular system or of a fixed system having a variable drive control.

This object is achieved by the fact that the device comprises at least a second centrifugal separating module between the cooling module and the centrifugal pump module.

According to another feature, this object is achieved by the fact that the first module comprises at least two centrifugal separators mounted in series, so that the axial exit flow of the one constitutes the entry flow of the second, and means for coupling the first and second separator in rotation.

According to another feature, the coupling means consist of an electromagnetic clutch.

According to another feature, the device comprises at each end a device for centering relative to the extraction well.

Other features and advantages of the present invention will become more clearly apparent from a reading of the following description, made with reference to the accompanying drawings, in which.

Figure 1A:
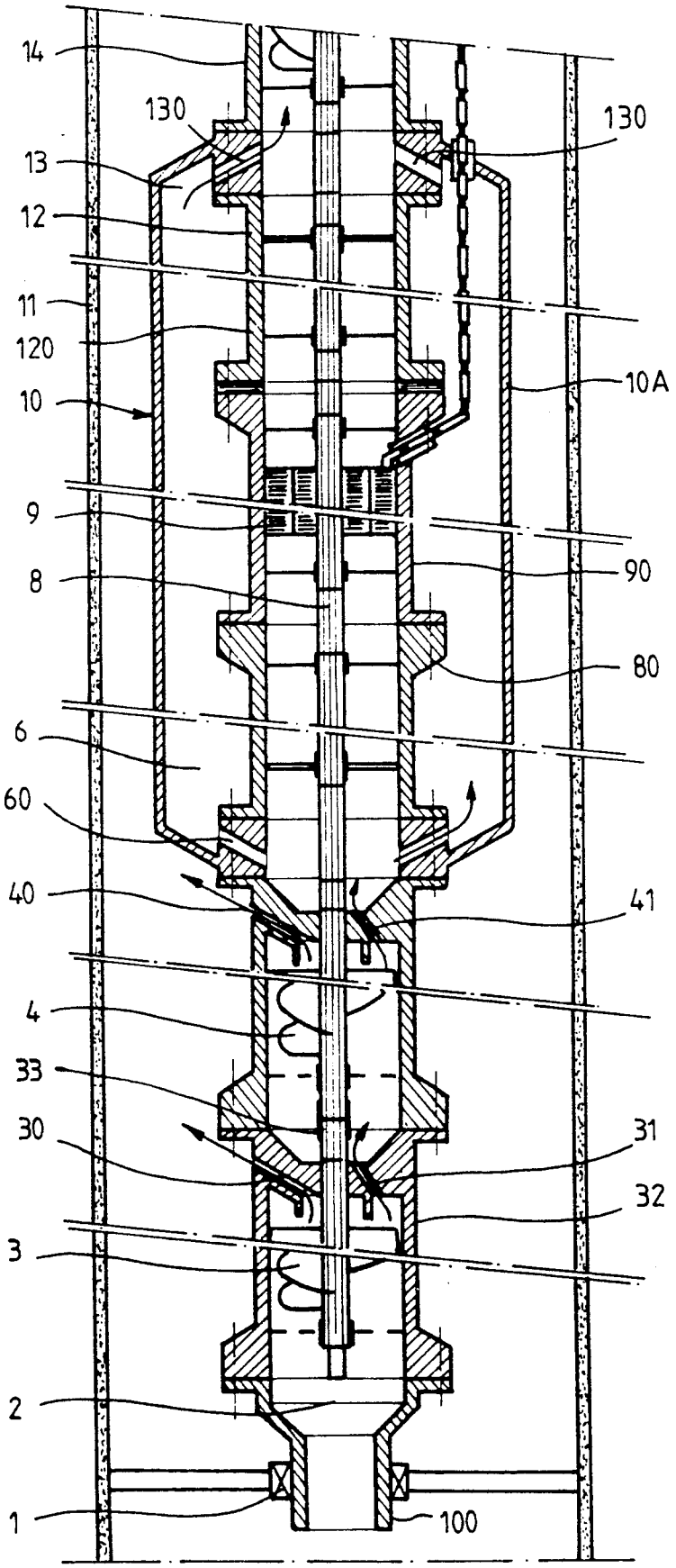
FIGS. 1A and 1B show the composition of the device enabling the process of the invention to be implemented.
Figure 1B:
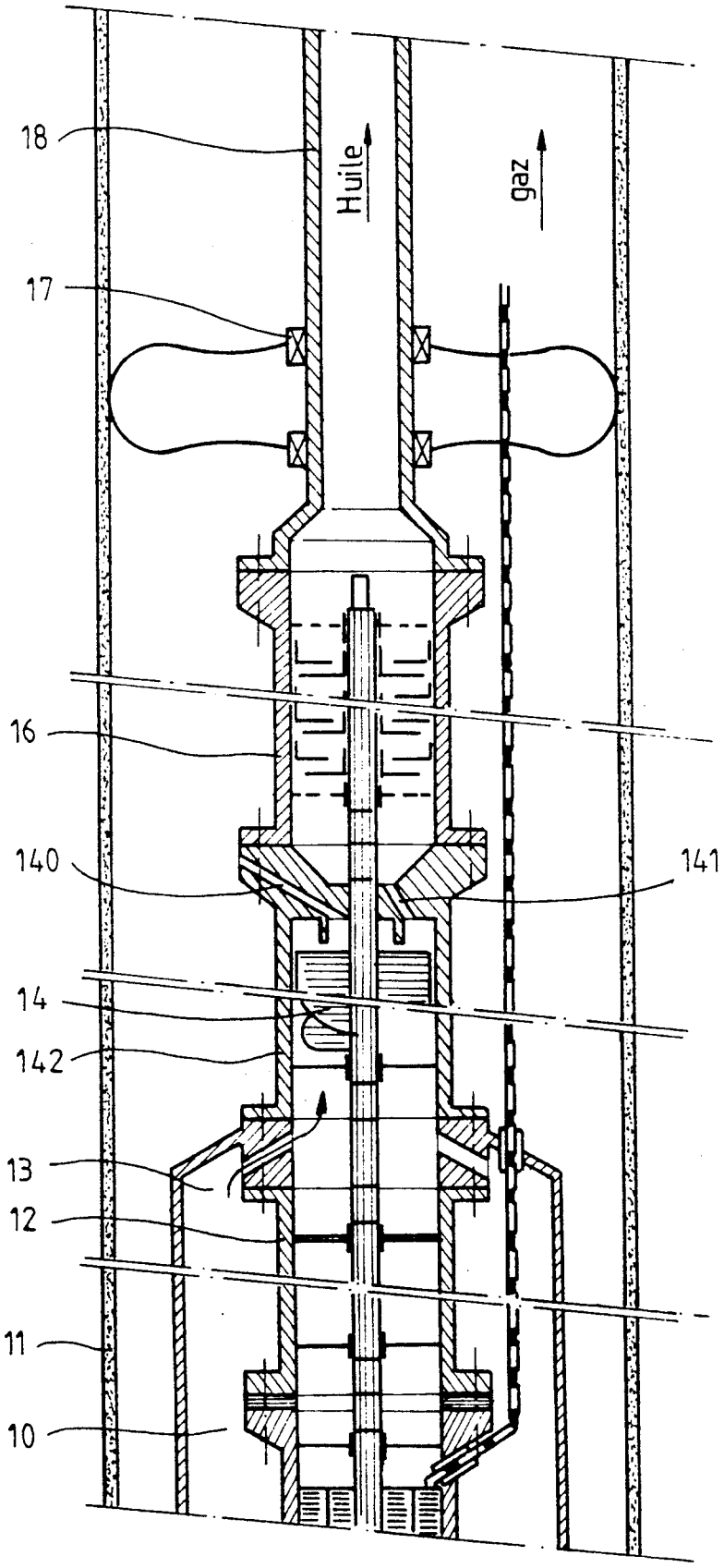

FIG. 1A shows the upstream part of the pumping device which enables the process according to the invention to be implemented. This device comprises a centering element (1), which may or may not be sealed, the central pipe (100) of which leads the gas and fluid mixture to a first centrifugal separator (3), whose gas discharge exit (30) discharges the gases into the annular space between the outer cylindrical casing (32) of the separator and the pipe (11) constituting the wall of the extraction well. The gas/fluid mixture whose percentage has been reduced by the first separator is discharged through an axial orifice (31), in the direction of a second separator (4), with a view to a further reduction in the percentage.

This separator (4) discharges the gas through an orifice (40) into the annular space, and the gas/fluid mixture through an axial orifice (41), in the direction of a cooling module (10) constituted by an element (6) which diverts the axial flow of the separator (4) through lateral orifices (60) towards an annular space formed between an outer pipe (10 A) and the successive outer pipes (80, 90, 120) respectively of the protecting modules (8), motor (9) and protector (12) which are mounted inside and coaxially with the pipe (10 A), thus forming the cooling module (10).

The protecting modules (8, 12) make it possible to ensure a seal at the level of the output shafts of the motor (9) towards the upstream side and towards the downstream side. Hereby, the motor element (9) is protected from contact with the fluids which circulate in the device. Moreover, the fluid flowing in the annular space formed between the pipe (10) and the outer casings (80, 90, 120) which form respectively the first protector, the motor and the second protector make it possible to ensure a cooling of the motor which is all the more efficient since the percentage of gas in the mixture has been brought down to as low a level as possible below 40%. At the downstream end of the cooling module, a diverting module (13) enables, by virtue of the orifices (130), the flow to be brought axially into the separating element (14) which follows the cooling module.

This separator (14), which is similar in composition to the other separators, discharges the gas through the orifice (140) towards the annular space between the outside of the casing (142) of the separating device and the pipes (11) constituting the wall of the extraction well. This separator (14) discharges the axial flow of the mixture towards a centrifugal pump (16) via the axial orifice (141). The exit of the centrifugal pump (16) is connected to an assembly of pipes (18), which makes it possible for the liquid, which is virtually separated from its gas, to rise to the surface.

A centering device (17) can also be used at the exit of the device.

The motor (9) drives by means of drive shafts which extend inside the device, both towards the separators located upstream and downstream and towards the centrifugal pump.

During operation, the two-phase mixture (2) penetrates into the system, and a part of the gas is separated and discharged via the annular space at the level of the first centrifugal separator (3) having axial flow.

The remaining mixture penetrates into the second separator (4), where the same operation is carried out. For a flow rate of the order of 200 $m^3$ per day, using a separator having a diameter of 125 mm driven at 3,000 revolutions/minute, and the percentage of free gas as the drawing means (2) being 99%, it will be possible for the percentage at the exit of the first separator (3) to be brought down to approximately 60%. The second separator will bring the percentage of gas to approximately 30%.

The fluid is thus sufficiently degassed so as to have a heat capacity which is sufficient for ensuring an efficient cooling of the motor. The fluid leaving the second separator (4) passes into the cooling module of the motor and subsequently penetrates into the third separator (14) in order to terminate its journey in the centrifugal pump and to then be discharged up to the surface, inside the pipe string (18). The gas in turn reaches the surface via the annular space formed between the pipe string (18) and the pipes (11) constituting the wall of the extraction well. The third separator will bring the percentage of gas, which is 30% at the entry, to a percentage which is compatible with the smooth running of the pump (16), generally less than 8%.

It is clearly evident that the third separator (14) is optional and depends on the percentage of gas contained in the initial two-phase liquid. Thus, in the case of an initial two-phase mixture whose gas percentage is slightly greater than 70%, the two separators (3, 4) will be used, but it may be possible to dispense with the last separator (14). On the other hand, in the case of a two-phase mixture between 70 and 40%, only a single separator (3) upstream of the motor and a second separator (14) downstream of the motor will be used.

In the variant shown, the drive shafts of the first and second separators (3, 4) are connected mechanically in rotation by means of a muff (33).

In an alternative embodiment of the invention, it will be possible for these shafts to be connected mechanically by means of an electromagnetic clutch controlled from the surface so as to implement, as required, one or two separating modules upstream of the motor.

Figure 2:
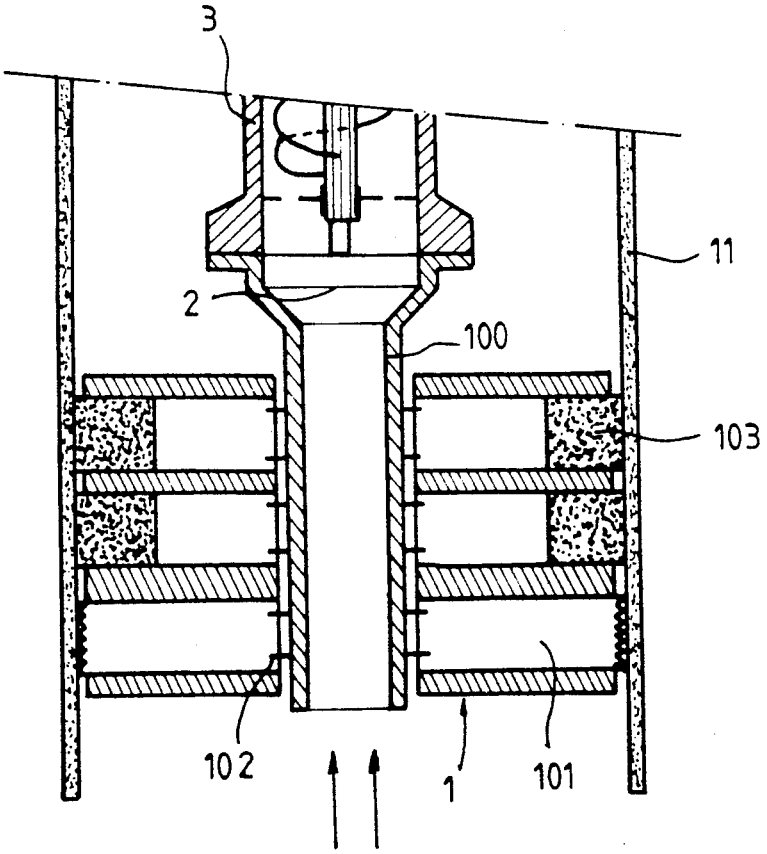
FIG. 2 shows a view of a centering device used in the invention.

FIG. 2 shows a sealed centering element (1) used upstream of the device. This centering element consists of anchoring chocks (101) connected, on the one hand, to the outer pipe (11) of the extraction well by means of seals (103), and, on the other hand, to the inner pipe (100) for drawing the two-phase liquid (2), by means of gaskets (102), so as to channel the two-phase mixture towards the inside of the pipe (100).

The unsealed centering device (17) located downstream of the pumping device will solely comprise spacers for supporting the pipes (18) to enable the gas to flow outside the pipe (18).

It is clearly evident that, depending on the case, an unsealed centering piece (1) may be used. Similarly, it will be possible, if appropriate, to use a sealed centering piece for the exit centering piece (17).

I claim:

1. A process for pumping a two-phase gas/liquid mixture in an extraction well whose initial gas percentage is greater than approximately 40% by volume, comprising:

passing said mixture through at least a first centrifugal separating module to reduce the percentage of free gas in said mixture to below 40%;

passing the mixture which emerges from said first separating module annularly around a drive motor to cool said motor;

passing the mixture through at least a second centrifugal separating module to reduce the percentage of free gas in said mixture to below about 10% by volume; and pumping the mixture emerging from said second centrifugal module by means of a centrifugal pump driven by said drive motor.

2. The process according to claim 1, wherein said drive motor drives said first and second centrifugal separating modules as well as said centrifugal pump.

3. The process according to claim 1, wherein said gas/liquid mixture is oil in an oil extraction well.

4. An apparatus for pumping a two-phase gas/liquid mixture in an extraction well whose initial gas percentage is greater than approximately 40% by volume, comprising:

a first centrifugal separating module having a cylindrical casing providing for axial flow of the gas/-liquid mixture and means for discharging the separating gases outside the casing;

a cooling module comprising an outer casing connected in a sealing manner to the casing of the first separating module and, within said outer casing, a second coaxial cylindrical casing containing a motor which is surrounded on either side, in the longitudinal direction, by means for maintaining a seal towards the upstream and downstream sides at the level of the drive spindles of the motor;

means for diverting the axial flow of the gas/liquid mixture outside the second casing at the entry of the cooling module; and means at the exit of the cooling module for bringing the flow along the axis of a centrifugal pumping module connected to a pipe string for discharging the fluid, the pumping module and separator being driven by the motor.

5. Device according to claim 4, further comprising a second centrifugal separator module disposed between the cooling module and the centrifugal pumping module.

6. The apparatus according to claim 4, wherein said first centrifugal separator module comprises at least two centrifugal separators mounted in series so that the axial exit flow of one constitutes the entry flow of the outer and means for coupling the drive shafts of each separator in rotation.

7. The apparatus according to claim 6, wherein said coupling means comprises an electromagnetic clutch controlled from the surface.

8. The apparatus according to claim 4, further comprising means for centering the apparatus within the extraction well.

* * * * *